US007066123B2

(12) United States Patent
Richardson

(10) Patent No.: US 7,066,123 B2
(45) Date of Patent: Jun. 27, 2006

(54) VARIABLE VALVE OPENING FOR AN INTERNAL COMBUSTION ENGINE

(76) Inventor: Donald G. Richardson, P.O. Box 1690, Sutter Creek, CA (US) 95685

( * ) Notice: Subject to any disclaimer, the term of this patent is extended or adjusted under 35 U.S.C. 154(b) by 0 days.

(21) Appl. No.: 11/045,716

(22) Filed: Jan. 28, 2005

(65) Prior Publication Data

US 2005/0126528 A1 Jun. 16, 2005

Related U.S. Application Data

(63) Continuation of application No. 10/354,912, filed on Jan. 30, 2003, now abandoned.

(60) Provisional application No. 60/352,953, filed on Jan. 30, 2002.

(51) Int. Cl.
*F01L 1/18* (2006.01)

(52) U.S. Cl. ..... 123/90.41; 123/90.39; 123/90.43; 123/90.12

(58) Field of Classification Search ..... 123/90.39, 123/90.44, 90.45, 90.46, 90.61, 90.65, 90.12, 123/90.13, 90.41, 90.43
See application file for complete search history.

(56) References Cited

U.S. PATENT DOCUMENTS

| | | | | |
|---|---|---|---|---|
| 2,934,051 | A * | 4/1960 | Drew | 123/90.43 |
| 3,797,760 | A | 3/1974 | Davis et al. | |
| 3,882,833 | A * | 5/1975 | Longstaff et al. | 123/90.11 |
| 3,964,455 | A | 6/1976 | Brown | |
| 4,134,371 | A | 1/1979 | Hausknecht | |
| 4,153,016 | A | 5/1979 | Hausknecht | |
| 4,483,283 | A | 11/1984 | Hausknecht | |
| 4,716,863 | A | 1/1988 | Pruzan | |
| 4,762,095 | A | 8/1988 | Mezger et al. | |
| 4,852,527 | A | 8/1989 | Beardmore | |
| 4,889,085 | A | 12/1989 | Yagi et al. | |
| 4,919,089 | A | 4/1990 | Fujiyoshi et al. | |
| 5,092,284 | A | 3/1992 | Yamada | |
| 5,233,951 | A | 8/1993 | Hausknecht | |
| 5,327,858 | A | 7/1994 | Hausknecht | |
| 6,006,706 | A | 12/1999 | Kanzaki | |

* cited by examiner

*Primary Examiner*—Thomas Denion
*Assistant Examiner*—Ching Chang
(74) *Attorney, Agent, or Firm*—Albert O. Cota

(57) ABSTRACT

An intake or exhaust valve for an internal combustion engine has a rocker arm with a pivot between its ends, one end of which is engaged by the pushrod, and the other end engages the valve stem. An adjustable stop has two positions for the rocker arm pivot; a rest position where there is no movement of the pivot, and an upper lock position where the pivot moves in response to the pushrod, and there is a reduction in the opening of the valve. A progressive rate spring compresses as the pivot moves towards the upper lock position, thereby modulating valve opening for relatively slow start (or stop) of valve stroke with accelerating (or decelerating stroke), as the progressive rate spring compresses (or expands). Relatively thinner and thicker Belleville springs are used in series to produce a progressive rate spring. The lock position of the pivot elevated above the rest position is determined by a hydraulic block trapping oil in a closed chamber. One or more intermediate lock positions can be provided by varying the available volume of the closed chamber. An inner sleeve is rotated to obstruct one or more holes for fluid passage and an outer sleeve moves longitudinally to hit hydraulic block when an end passes the highest of such holes.

8 Claims, 8 Drawing Sheets

VARIABLE VALVE OPENING FOR AN INTERNAL COMBUSTION ENGINE

CROSS-REFERENCE TO RELATED APPLICATION

This Continuation Application claims the benefit of U.S. application Ser. No. 10,354,912, filed Jan. 30, 2003, now abandoned, which claims the benefit of U.S. Provisional Application No. 60/352,953, filed on Jan. 30, 2002.

BACKGROUND OF THE INVENTION

There are times when it may be desirable for intake and exhaust valves of an internal combustion engine to open less than the full stroke driven by the camshaft. This affects engine performance as a function of speed and may improve fuel efficiency and reduce emissions. With a smaller valve opening less air or fuel-air mixture may be drawn into the cylinder and/or exhaust may be discharged less rapidly. The timing of the intake and the exhaust valves of a cylinder may also be regulated so that there is little, if any, overlap when both valves are partly open.

The present invention relates to internal combustion engines with rocker arms for operating the valves. The rocker arms are pivoted by pushrods engaging a rotating camshaft and the rocker arms open valves to the engine cylinders. In such arrangements, a valve opens a certain distance in direct proportion to the eccentricity of the cam or stroke of a pushrod.

In an engine employing this invention, the cam remains the same and the stroke of the pushrod remains the same. Means are provided, however, for reducing the stroke of the valve relative to the stroke of the pushrod. Broadly, this is accomplished by permitting the rocker arm pivot to move.

BRIEF SUMMARY OF THE INVENTION

An internal combustion engine has intake and exhaust valves, each pivoted between their ends, with one end engaged by a pushrod and the other end engaged by a valve stem. The pivot supporting the rocker arm is selectively movable pivot between a lower rest position and an upper lock position determined by liquid trapped in a volume which is closed in response to upward movement of the pivot. The pivot has an intermediate lock position between the rest position and the upper lock position.

Other features gradually start the valve opening before or upon the pivot reaching a lock position.

BRIEF DESCRIPTION OF THE DRAWINGS

Embodiments of how this is done are illustrated in the following drawings wherein.

DETAILED DESCRIPTION OF THE INVENTION

Somewhat broadly stated, the concept is to permit the center pivot of the rocker arm to move in response to the pushrod until it reaches an adjustable "stop" and then further stroke of the pushrod opens the valve. Opening the valve after reaching the stop may, however, start too rapidly. Thus, means are provided for gradually starting valve opening before or upon reaching the lock position.

Figure 1:
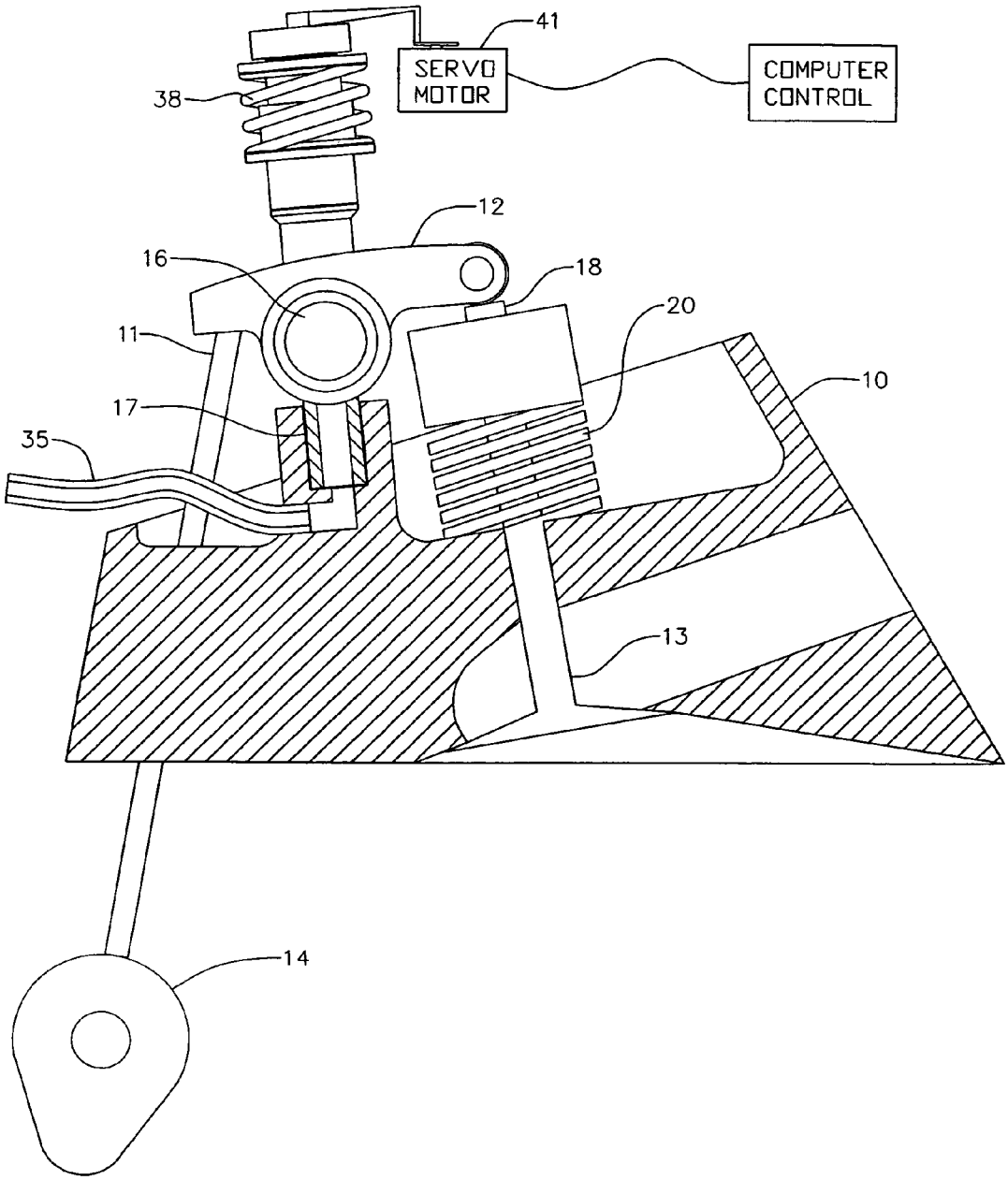
FIGS. 1, 2 and 3 illustrate semi-schematically operation of a valve in an internal combustion engine in three different valve and rocker arm positions.
Figure 2:
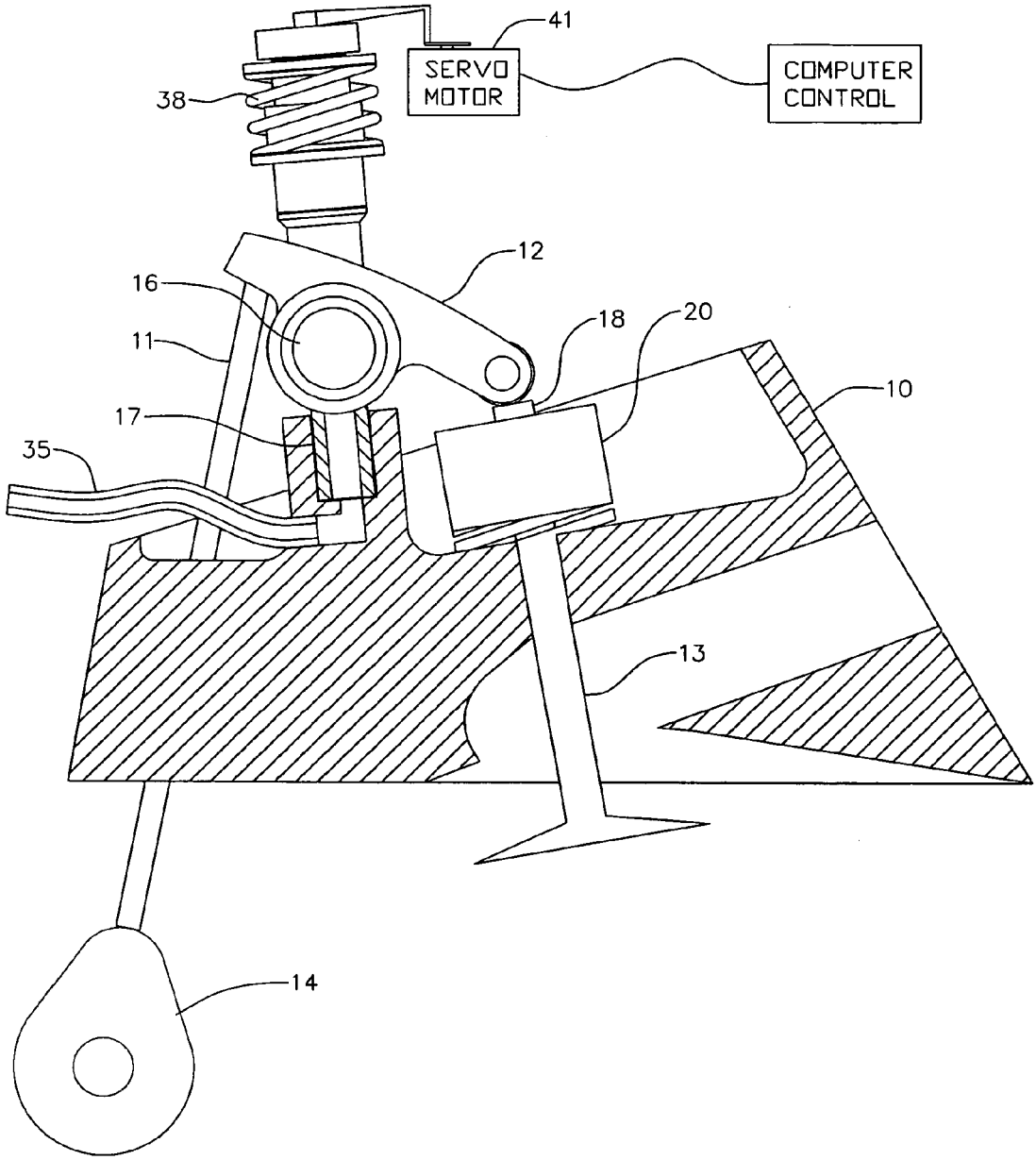

This is illustrated in the first three drawings. These drawings are schematic transverse cross-sections through a head 10 for an engine illustrating one pushrod 11, rocker arm 12 and valve 13. The pushrod is activated by a cam 14 on the engine camshaft and engages one end of the rocker arm. The rocker arm pivot 16 is mounted transverse to a tube 17 secured to the head. The opposite end of the rocker arm engages the stem 18 of an intake or exhaust valve. When the camshaft is rotated so this cam is in its minimum diameter position, the pushrod is retracted and the valve is closed as illustrated in FIG. 1. When the camshaft rotates so that the top of the cam 14 engages the pushrod, the rocker arm pivots to press the valve stem, compress the valve spring 20 and open the valve, as illustrated in FIG. 2.

Figure 3:
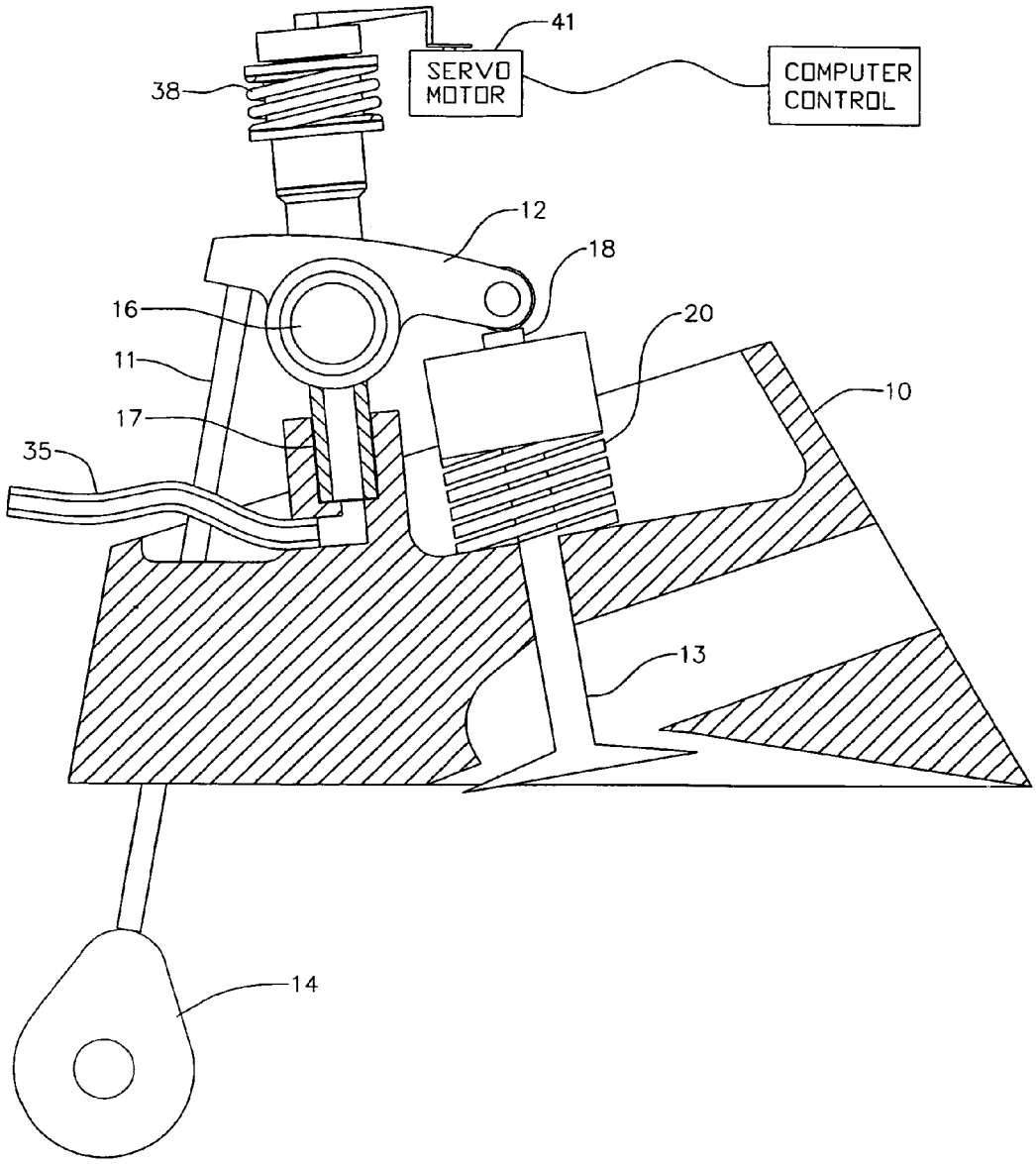

FIG. 3 illustrates what occurs in practice of this invention. When the cam pushes on the pushrod, the mechanism mounted on the end of the tube 17 supporting the pivot permits the pivot to move away from the engine head. The parts are configured so that the force required to compress a spring 38 and move the pivot is less than required to compress the valve spring and open the valve. After a selected stroke or movement of the pivot away from the head, it reaches an end position (an adjustable "stop" described hereinafter) and further advance of the pushrod forces pivoting of the rocker arm and depression of the valve stem, thereby opening the valve. Since the pivot has moved to a new position, the stroke of the valve stem and hence opening of the valve are less than when the pivot was in its original position as illustrated in FIGS. 1 and 2.

Figure 4:
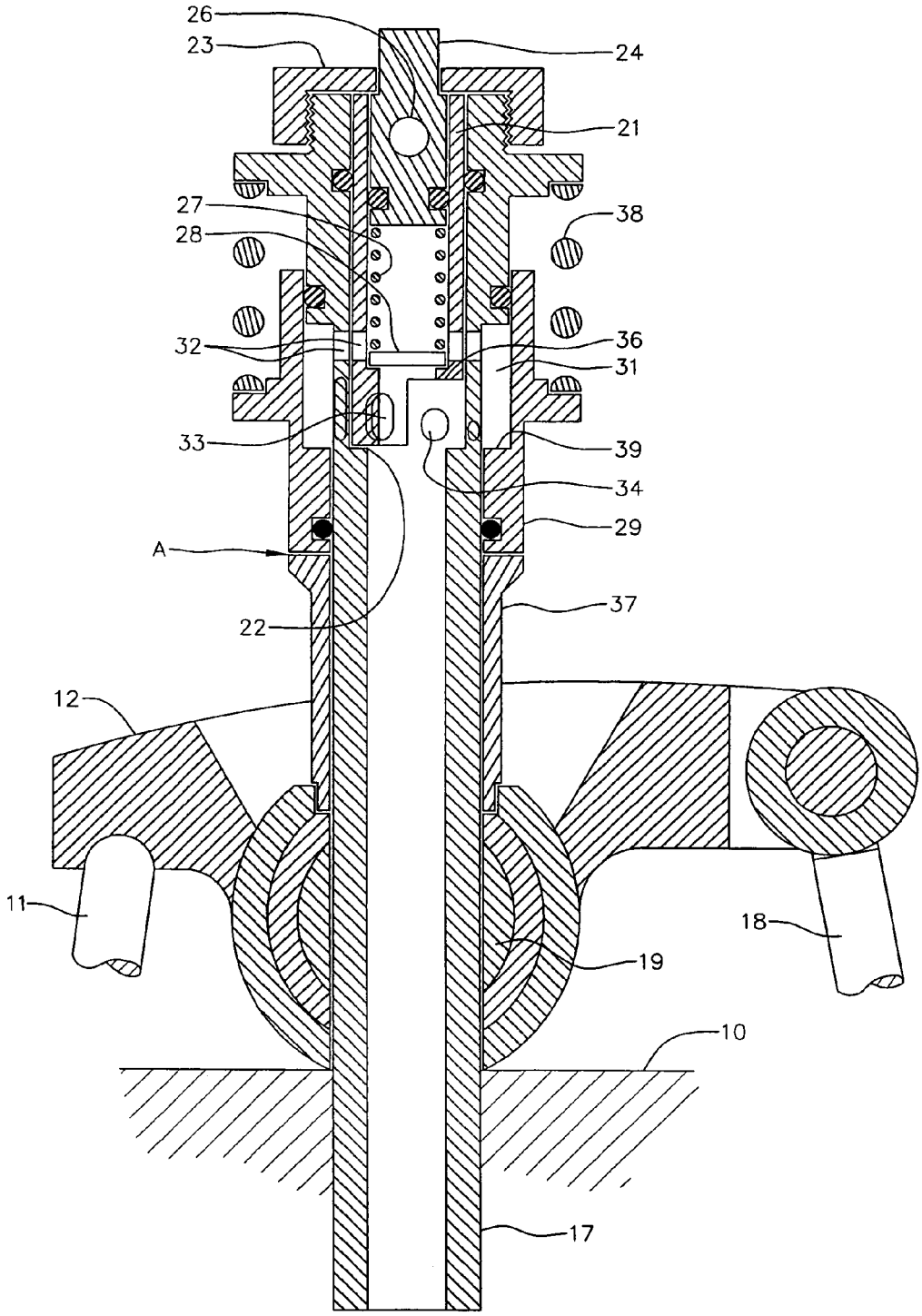
FIG. 4 is a longitudinal cross-section through the operating mechanism for moving the rocker arm pivot.

In a typical engine, the rocker arm has its pivot (which typically has two bearings) on a shaft connected to the head. The pivot is held down by a nut on the shaft and is thereby fixed in position. In the embodiment illustrated in FIG. 4, the shaft is replaced by a tube 17 on which the pivot is mounted. The full pivot structure is not illustrated in FIG. 4, but it comprises a central shaft 18 transverse to the tube 17, and needle bearings on which the rocker arm is mounted. The portions illustrated are supports that do not tilt with the rocker arm. Instead of a nut on the tube to hold the rocker arm pivot in a fixed position, there is an actuator mechanism at the top end of the tube to permit the pivot to move. (It is to be understood that top, bottom, upper, lower, above or below are used herein relative to the drawings for convenience of description and do not necessarily relate to engine orientation.) Because of this actuator, the entire rocker arm assembly, including the pivot shaft 19 on which the rocker 12 is mounted, can slide up and down on the tube 17. The lower-most position of the pivot assembly is against the head 10, as illustrated in FIG. 4. The pivot assembly can move upwardly along the tube a distance controlled by the actuator.

An inner sleeve 21 fits into the upper end of the tube and is held down against a shoulder 22 by a threaded cap 23. A rotatable plug 24 fits through the cap into the inner sleeve and is secured to the sleeve by a roll pin (not shown) in a transverse hole 26. Thus, the inner sleeve rotates with the plug. A light spring 27 presses downwardly on a disk 28 to form a check valve in the inner sleeve.

An outer sleeve 29 fits around the outside of the tube and is sealed to the tube by O-rings to define an annular chamber 31. A number of circumferential slots 32 are provided through the wall of the tube and the inner sleeve 21 to provide fluid communication between the annular chamber 31 and the interior of the inner sleeve above the check valve. These slots remain open at all times and are wide enough to extend a major part of the circumference of the tube and inner sleeve, respectively, leaving only enough metal between the slots for mechanical support. Desirably, there is a different number of slots in the tube and in the sleeve so that, regardless of rotational position of the inner sleeve relative to the tube, there is a maximum open cross-section for radial fluid flow.

One, two or more radial holes extend through the wall of the tube near the shoulder 22 to provide controllable fluid communication between the interior of the tube 17 and the annular chamber 31. Two such holes are illustrated in FIG. 4; a first hole 33 which is relatively long and a second hole 34 which is relatively short. The drafting convention used illustrates the holes as if fully seen, even though all or part of the holes may be obscured by other parts of the structure in a longitudinal cross section along the centerline of the mechanism. Thus, the hole 34 may be seen, but the hole 33 could be hidden by the end of the plug. Similarly, two ovals are drawn within the cross-hatched portion of the tube. These are presented to show the relative heights of two additional holes otherwise completely hidden in this view. (This may be further recognized by reference to FIG. 5).

The lower end of the inner sleeve 21 is cut away for half of its circumference from its lower end to a level 36 a short distance below the check valve. When the inner sleeve is rotated to one position, the lower end which is not cut away lies in front of the radial holes 33 and 34 through the wall of the tube, thereby preventing fluid flow between the interior of the tube and annular chamber. When the inner sleeve is rotated 90°, as illustrated in FIG. 4, for example, the shorter hole 34 is in the cut-away portion and fluid flow is permitted through the hole 34 while the longer hole 33 remains blocked by the lower end of the sleeve which is not cut away. Upon an additional 90° of rotation, both the holes 33 and 34 are open for fluid flow.

Thus, there are three control positions for the inner sleeve.

1. Both holes are closed.
2. The shorter hole is open and the longer hole is closed.
3. Both holes are open.

It should be recognized that the illustrated embodiment with three active positions with half of the lower end of the sleeve cut away, is just one embodiment. The amount cut away might be different, or a different number of holes of differing lengths provided through the wall of the tube.

The inside of the tube 17 is connected through a passage 35 (FIGS. 1 to 3) to a source of pressurized fluid, conveniently lubricating oil for the engine at the pressure delivered by the oil pump. A typical pressure of about 30 psi is ample for operation of the actuator. The oil is not used for hydraulic actuation, it serves as an incompressible fluid to provide a hydraulic block or adjustable stop.

When the inner sleeve is rotated to a position where the portion that is not cut away blocks all of the holes through the wall of the tube, the pivot location of the rocker arm remains in its lower-most position, as illustrated in FIG. 4, just as if it were held in place by a nut. Engine oil is inside the inner sleeve and annular chamber. There is no place for it to go, so it blocks movement of the outer sleeve along the length of the tube.

Assume, however, that the inner sleeve is rotated so that one of the radial holes 34 is open for fluid flow, as illustrated in FIG. 4. Since the shorter hole 34 is open, oil can flow freely between the inside of the tube and the annular chamber 31, and also through the radial slots 32 into the space in the inner sleeve above the check valve. Now, when the pushrod presses against an end of the rocker arm, there is a force transmitted from the rocker pivot to the outer sleeve 29 by a tubular link 37 around the tube 17. Since the spring 38 biasing the outer sleeve 29 toward its downward position is much weaker than the valve spring, the link and outer sleeve can move up, thereby permitting the pivot to move up. Oil in the annular chamber can flow through the shorter hole 34 into the inside of the supporting tube 17 as the chamber gets shorter.

However, when the lower end wall 39 of the annular chamber reaches the top of the hole 34 through the wall of the tube, such flow is blocked. At this moment, there is a trapped volume of oil within the inner sleeve and reduced volume of the annular chamber. Since flow from this volume is substantially prevented, there is a hydraulic block to further upward movement of the outer sleeve. When this block occurs, movement of the pivot of the rocker arm along the tube is immediately arrested. Further stroke of the pushrod then pivots the rocker arm so that the opposite end presses on the valve stem and opens the valve. Since the pivot point is now located above its rest position against the block (as illustrated in FIG. 4), the stroke of the valve and valve opening are proportionately reduced. It will also be noticed that there is also a change in timing; the valve begins opening later and closes earlier.

As the cam continues to rotate and the pushrod retracts, the rocker arm pivots back under the force of the valve spring, the valve closes and forces tending to lift the rocker arm pivot off of the head are reduced so that the spring 38 on the outer sleeve can push the rocker arm pivot back toward its lower position adjacent the head. As soon as the lower end wall of the annular chamber passes the upper end of the hole 34, oil pressure within the tube can augment the return force of the spring. The check valve permits oil to flow into the volume in the inner sleeve and the annular chamber to prevent the outer sleeve from locking in an upper position.

The actuator mechanism that sets the location of the hydraulic block to movement of the pivot selects that location in response to rotation of the inner sleeve. A servomotor 41 is linked to the plug 24 which is keyed to the inner sleeve. The servomotor is controlled by an engine computer which selects the desired servomotor setting as a function of engine operating conditions, primarily engine speed. The conventional engine computers on most models of automobiles are suitable. When instructed by the computer, the servomotor rotates the plug and inner sleeve through a selected angle to open (or close) one or more of the holes through the wall of the tube.

Thus, there is a stop with adjustable increments for movement of the pivot. The first position of this stop is with the inner sleeve rotated so that all of the holes through the wall of the tube are blocked. The pivot cannot move along the tube. Additional adjustable stop positions are with one, two or more such holes open.

Figure 5:
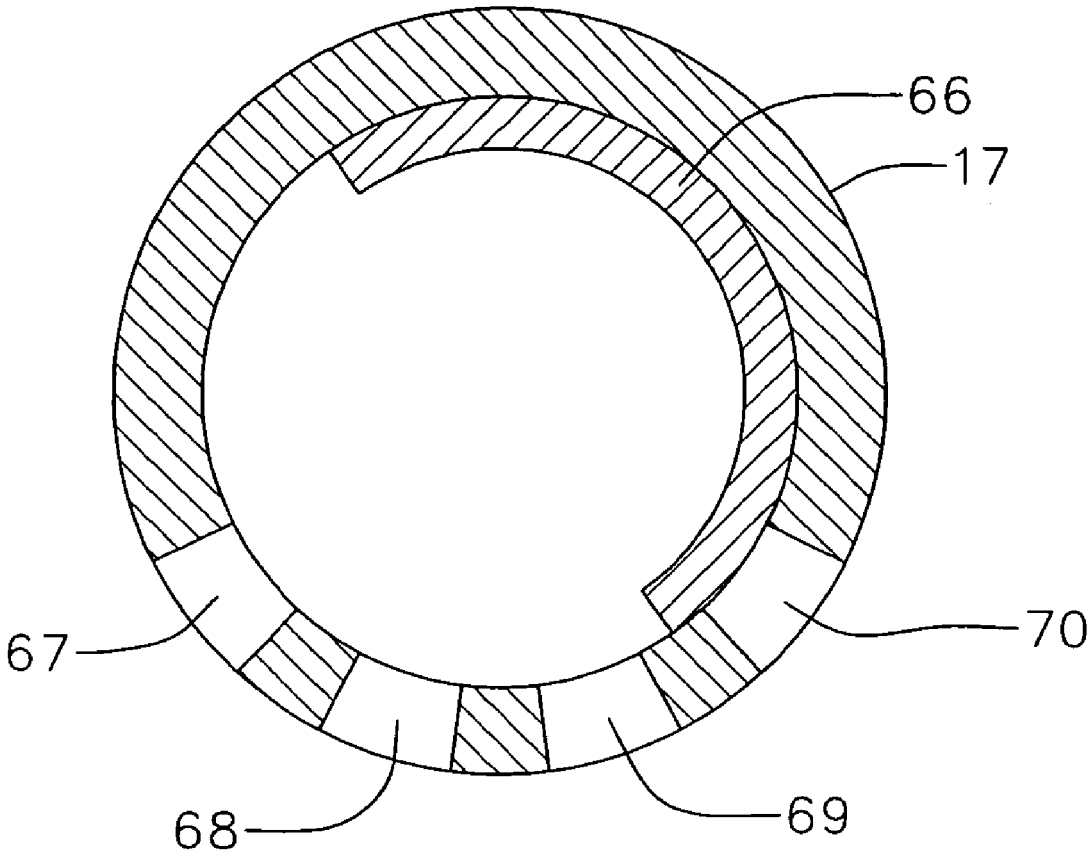
FIG. 5 is a partial transverse cross-section through the lower end of the control plug and surrounding tube of a prototype embodiment of operating mechanism.

For example, in one prototype, as illustrated in FIG. 5, one-half of the lower end of the inner sleeve is cut away, leaving one half 66 of the circumference intact to block holes through the tube. There are four radial holes 67–70 of four differing heights through the wall of the tube. One of the holes 67 has a short longitudinal extent along the tube. The next hole 68 has a somewhat longer longitudinal extent. The third hole 69 has a still longer longitudinal extent. The fourth and final hole 70 has the longest longitudinal extent. That is, the upper edges of each of the respective holes is successively further from the pivot than the preceding hole. These holes extend circumferentially less than halfway around the circumference of the tube.

Thus, in such an embodiment, there are five control positions with none of the holes open, one, two, three, or all four holes open, respectively. In the illustration of FIG. 5, the plug is rotated so that the cutaway portion is opposite the three shortest holes 67, 68 and 69. The remaining portion of the lower end of the plug lies in front of the longest of the holes 70, thereby blocking flow through that hole. Locking of the stroke of the pivot away from its rest position occurs when the shoulder in the outer sleeve reaches the upper edge of the longest open hole 69. With the three shorter holes open, the control of pivot position is in the fourth of the five possible positions. Having a larger number of holes provides greater control of the degree of opening of the valve. It will also be apparent that a single hole might be used for just two valve opening positions, one for idling and one for faster engine operating speed, for example.

In the illustrated embodiment, the holes through the wall of the tube are round or oval. It may be desirable to make the upper end of such a hole V-shaped so that oil flow is more gradually restricted as the outer sleeve approaches the hydraulic block position where the lower end wall of the annular chamber blocks the hole. The addition of flow resistance just before the complete hydraulic block can reduce impact-type loading.

As illustrated, the tube 17 is merely inserted into the head. The tube needs to be inserted into the head a selected distance, and also needs to be oriented correctly so that the holes are aligned properly for coverage by the inner sleeve as it is rotated by the servomotor. There are several ways of doing this, some of which are more convenient than others for retro-fitting existing engines. One way, for example, is to align the tube with the head by means of a key or non-round mounting hole and secure it to the head by a nut threaded into a counterbore. Shoulders set the depth of the tube into the head. Different lengths of link 37 may also be used.

Several things are to be understood with respect to this disclosure. The valve and rocker arm described and illustrated may be for either intake or exhaust. The rocker arm is illustrated asymmetrically, i.e., the end engaging the pushrod is shorter than the end engaging the valve stem, and the description states that the pivot is in the "center". This is a matter of convenience in nomenclature and is not intended as a requirement that the pivot be geometrically centered on the rocker arm, only that it is between the two ends of the rocker arm.

Also, the passage for bringing engine oil to the tube supporting the rocker arm is shown passing through the head. It is more convenient to have a shorter passage coming through the top of the head than the bottom. Other changes from the design illustrated will be apparent, and this embodiment is illustrated solely for convenience in describing the invention.

In the embodiment illustrated, it appears that a servomotor is provided for the individual actuator. However, it may be preferable to have a single servomotor linked to several actuators. Thus, for example, all of the actuators for both intake and exhaust, may be linked together to respond together. A wire with about the stiffness of a bicycle wheel spoke is adequate for rotating the inner sleeves synchronously. The holes through the tube wall through which oil flows may be different for intake and exhaust if different responses are desired in the intake and exhaust valves. Alternatively, all the intake actuators may be linked together separately from linkage to all of the exhaust actuators. Separate linkages may be used on halves of a V-8 engine, for example.

In the exemplary embodiment, O-rings are used for hydraulic seals in the actuator mechanism. The dynamic seals in the actuator mechanism may be metal or polymer seals for enhanced lifetime. It may be noticed that there is an unsealed path between the outside of the inner sleeve and the inside of the tube, and between the outside of the tube and the lower end wall of the annular chamber when the actuator mechanism is in hydraulic block. Thus, minor fluid flow may occur between the annular chamber and inside of the tube 17 when the outer sleeve has reached the hydraulic block position. With a tight fit between the parts, the amount of fluid flow is negligible at engine operating speeds and additional seals are not considered necessary.

Absolute sealing to the outside is not important since everything involved is bathed in engine oil inside the rocker arm cover. Furthermore, some leakage is actually desirable for start-up. The volume within the inner sleeve and annular chamber is nearly a dead-end without flow-through of oil. Air trapped within that volume is like a compressible spring and interferes with forming a definite stop for movement of the pivot. Venting or "leakage" of air from that volume is therefore desirable. Some leakage may be provided by making one of the nearly static seals less than perfect, or by leaving a tiny "weep hole". The seal around the plug 24 may be between the plug and cap 23 instead of to the inner sleeve. The thread of the cap can then serve as a slightly leaky labyrinth seal. This would permit deletion of the seal ring between inner sleeve and tube.

A preferred way of bleeding air from the actuator is by making the plug 24 by powder metallurgy so that it has a controlled porosity. This can be fabricated so that air can flow relatively freely, but the higher viscosity of oil limits flow to an acceptable amount.

A short run-in period may be desirable to assure venting of air in a new installation of actuator (either for a new engine or a retrofit). Thereafter, the actuator volume should stay filled without significant draining of oil when the engine is shut off. Viscosity of oil in the air venting path should prevent in-flow of air since the only force is gravity acting on the oil.

If such draining after an engine is shut off is believed to be a shortcoming, an electronically valved accumulator may be connected to the tube on the closed side of a check valve in the tube to supply engine oil under pressure as soon as the ignition is turned on and even before oil pressure is applied from the oil pump. Such an added check valve in the tube somewhere below the actuator would also minimize draining of oil from the actuator volume while an engine is shut off.

In another embodiment for incremental adjustment of the hydraulic block position, the inner sleeve may be free to plunge longitudinally in the tube instead of rotating. A different arrangement of holes through the wall of the tube at successively higher locations is used and/or the inner sleeve is cut away differently. Several arrangements are apparent for multiple increments of adjustable stop positions. Such an embodiment is particularly well suited to an engine where there are just two hydraulic block positions, hole open and hole closed, since the plunging sleeve can be readily controlled with a two position solenoid instead of a servomotor.

Alternatively, instead of having an adjustable stop employing a hydraulic block, a mechanical stop may be used with a solenoid controlling the mechanical stop. The simplest embodiment of this is believed to be one where the force of pushrod and valve spring are not enough to cause motion of the rocker arm pivot from its position adjacent the head, against the force of a spring. A solenoid is used to augment the force acting on the spring and permit movement of the pivot. A smaller solenoid is needed than if the solenoid provided the resistance to movement of the pivot.

A solenoid in lieu of a servomotor may also be used for rotating an inner sleeve in a two position, hydraulic block embodiment.

It has been mentioned that control of the servomotor and hence sleeve position may be responsive to engine rotational speed. It is desirable to also have the actuator responsive to throttle settings so that changes in rpm can be anticipated and changes in pivot position made earlier. Manifold pressure and other engine operating parameters may also be considered in an algorithm for controlling the servomotor or solenoid.

Figure 6:
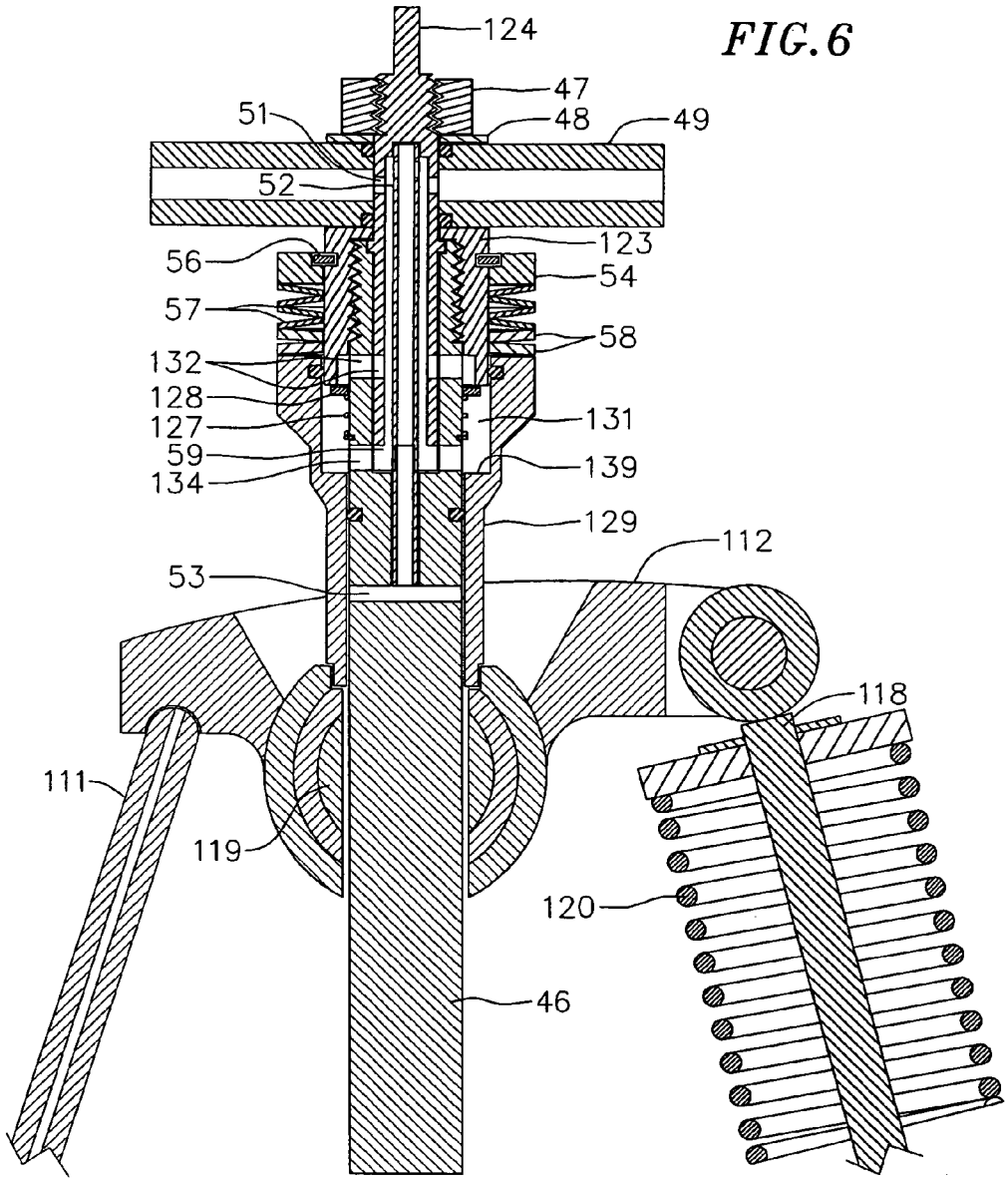
FIG. 6 is a longitudinal cross-section through a second embodiment of operating mechanism.
Figure 7:
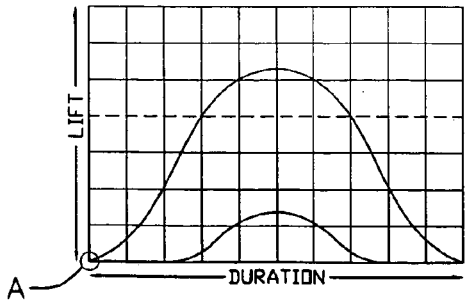
FIG. 7 is a graph of valve lift as a function of time.
Figure 8:
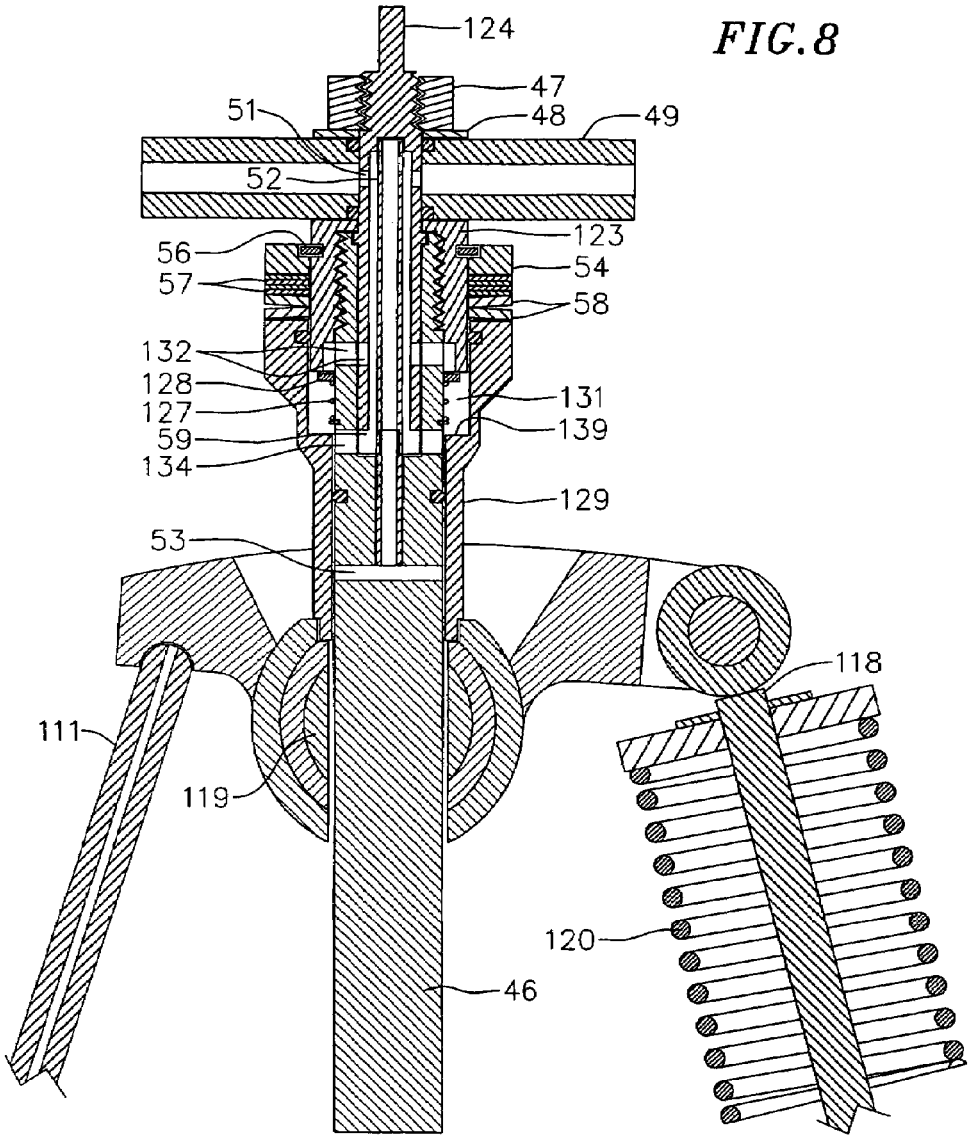
FIGS. 8 and 10 are cross-sections of the second embodiment in different positions during stroke of the pushrod.
Figure 9:
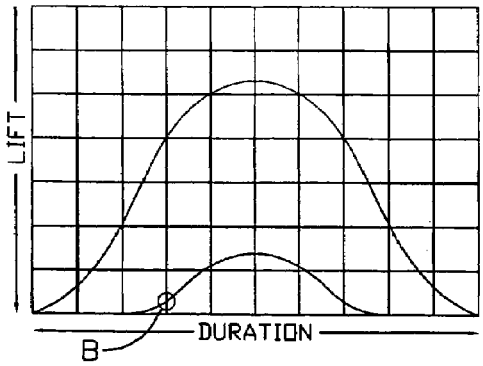
FIGS. 9 and 11 are graphs like that in FIG. 7 with different points on the curve illustrated.
Figure 10:
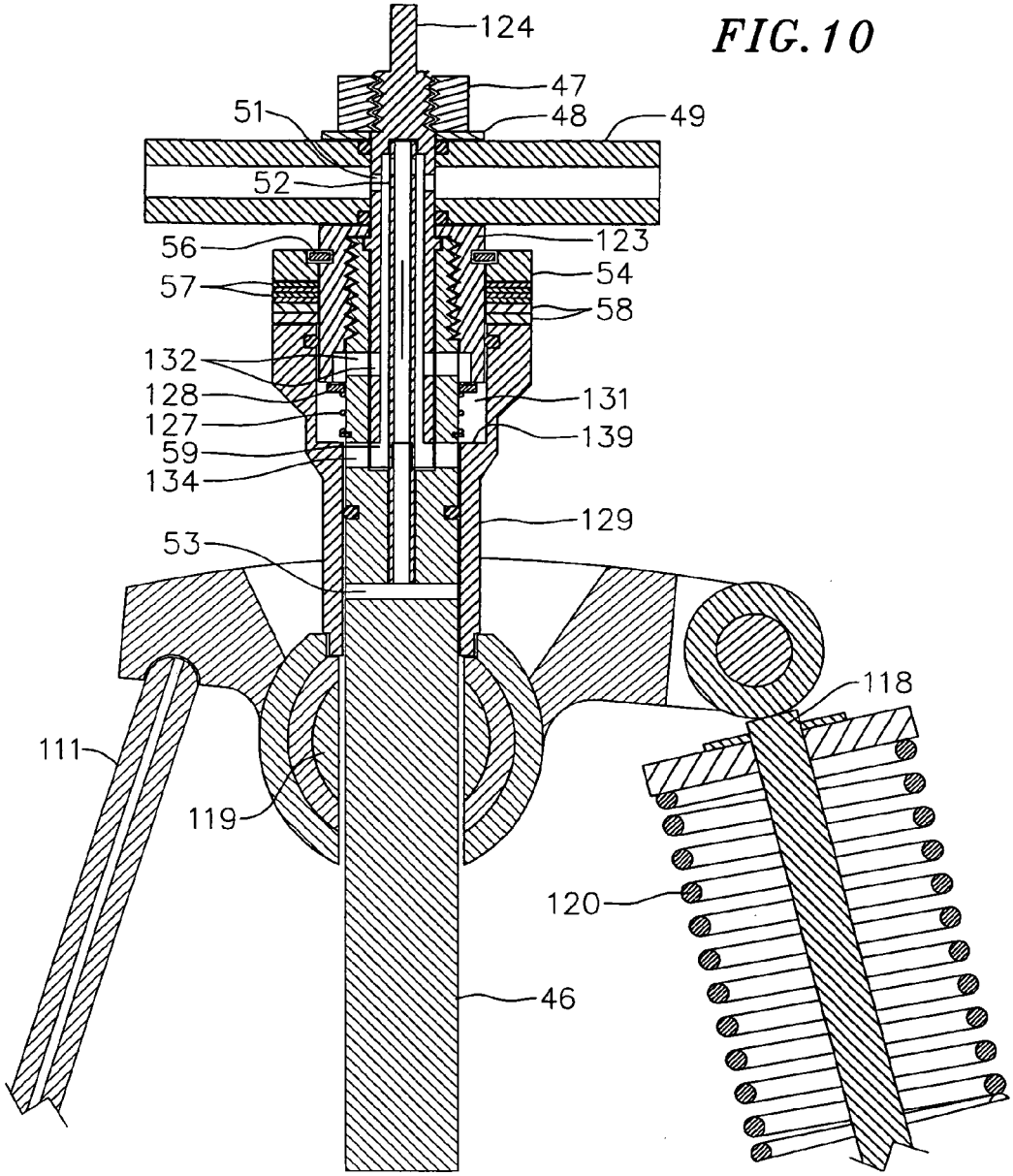
Figure 11:
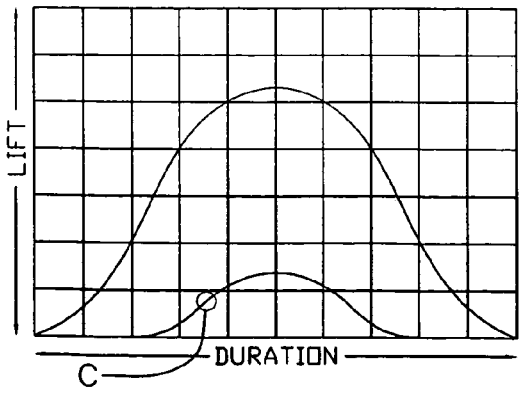

A second embodiment of operating mechanism for valve control is illustrated in FIGS. 6, 8 and 10 in positions where the pivot is in its rest position with valve closed, the pivot partly lifted, and fully lifted, respectively. FIGS. 7, 9 and 11 are the same graph of valve lift as a function of time with three points indicated on the respective copies of the graph corresponding to the three drawings 6, 8 and 10, respectively.

In the drawings 6, 8 and 10, several of the parts are indicated with reference numerals corresponding like parts in the first embodiment as illustrated in FIG. 4, plus 100. Thus, for example, the pushrod is identified as 11 in FIGS. 4 and 111 in FIG. 6. Other parts that differ from FIG. 4 have new reference numerals.

The second embodiment of operating mechanism for lifting the pivot of a rocker arm provides a different arrangement for bringing engine oil to the operating mechanism and, at least partly because of this, there are some differences in the structural details. The second embodiment also includes springs that modify the curve of lifting and closing the valve, thereby minimizing "hard" impacts. Thus, for example, the valve decelerates just before reaching the valve seat, so there is more of a soft landing than a hard impact as the valve closes. This is desirable, since the valve may open and close more than a billion times during its useful life, and the high stresses of hard impact could result in fatigue failure of some of the operating parts.

The operating mechanism is mounted on the engine head (not shown) by a shaft 46 on which the rocker arm pivot 119 is fitted. Connection of the shaft to the head is not illustrated, since how this is done is immaterial. The shaft is hollow at its upper end and receives a plug 124 which extends out of the end. As in the first embodiment, the plug is connected to a rotary actuator (not shown in the second embodiment), which rotates the plug to control the lifting of the pivot. A nut 47 is threaded onto the plug and locked in place so as to rotate with the plug. It serves to hold a washer 48 adjacent an O-ring seal for an oil supply manifold 49. Engine oil in the manifold enters the hollow interior of the head mounting member 46 by way of holes 51 through sides of the rotatable plug.

Engine oil also passes through holes near the top of an axial lubrication tube 52. Oil passes through the lubrication tube to a transverse passage 53 in the shaft 46 so it can enter the space inside an outer sleeve 129 and lubricate the sliding members and rocker arm pivot. This is, in effect, a bypass of engine oil from the supply manifold 49 through the operating mechanism (instead of around it or before it) and does not affect operation of the mechanism.

The outer sleeve sits on the rocker arm pivot and is biased upwardly by the pivot to permit movement of the pivot when the pushrod 111 starts the valve opening cycle, for example.

A cap 123 is threaded onto the upper or outer end of the hollow shaft and, among other things, secures the rotatable plug in a fixed axial position. The cap also supports a ring 54 held in place by a C-clip 56. The ring serves as a seat for Belleville washer springs between the ring and the movable outer sleeve 129. In the illustrated embodiment, there are four thin, and therefore "soft," Belleville washer springs 57. Next to these are two thick, and therefore stiff, Belleville washer springs 58. These springs resist lifting of the upper sleeve 129, and hence lifting of the rocker arm pivot.

Opposite the lower end of the rotatable plug, there are radial passages 134 through the wall of the hollow shaft. These communicate with the annular chamber 131 between the shaft and outer sleeve. The lower end of the rotatable plug has longitudinally extending slots 59 so that, upon rotation of the plug, the slots may be aligned with the radial passages 134 or a solid portion of the plug between the slots may obstruct the radial passages. As in the first embodiment, there is a check valve 128 which prevents oil flow out of the annular chamber 131 or permits flow into that chamber to keep the pivot from locking in a position away from its lower, rest position.

When the plug is rotated so that the solid portions block the radial passages through the shaft, the annular chamber 131 is closed off by the plug at one end and by the check valve at the opposite end. If the pushrod presses on the end of the rocker arm when the chamber is closed, oil in the chamber cannot escape, and the outer sleeve is locked in position. This prevents the rocker arm pivot from lifting from its rest position (as illustrated in FIG. 6), and the rocker arm operates the valve in the traditional manner. In other words, the stroke of the valve opening and closing is controlled as a direct function of the height of the cam.

When the plug is rotated so that one or more of the radial passages are open, actuation of the pushrod by the cam applies a force that tends to lift the pivot of the rocker arm and the outer sleeve 129, as well as pressing downwardly on the valve stem. The outer sleeve is free to move, since oil in the annular chamber can be displaced through the passages back toward the oil manifold. Such a partial stroke of the outer sleeve is illustrated in FIG. 8. Such movement of the outer sleeve can continue until the shoulder 139 reaches the upper end of the radial passages. At this point, the volume of the annular chamber above the shoulder is fixed and oil trapped in the chamber stops further motion of the outer sleeve. This upper lock position is illustrated in FIG. 10. Further stroke of the pushrod as operated by the cam results in further opening of the valve, as the pivot for the rocker arm remains fixed at its upper limit.

The Belleville springs 57, 58 modulate the movement of the rocker arm pivot and valve stem so that initially the rocker arm pivot moves in response to movement of the push rod without significant movement of the valve stem. Further along in the stroke of the pushrod, both the valve stem and the pivot move in response to further movement of the pushrod. When all of the Belleville springs are completely compressed, only the valve stem moves in response to further movement of the pushrod.

This is represented in the graphs of FIGS. 7, 9 and 11. In each of these graphs, the upper curve represents the lift of the valve (i.e., the valve opening) in response to the cam. This is the situation, for example, when the rotatable plug obstructs the radial passages into the annular chamber. The rocker arm pivot is locked in its rest position, and the pushrod, in effect, acts directly on the valve stem. The lower curve in the graphs represents the lift (opening) of the valve in response to the pushrod when the plug is rotated so that a radial passage is open and the rocker arm pivot can lift off of its rest position. This lower curve is represented, at least schematically, as about one-third of the lift of the valve when the pivot is locked in position. This height of the lower curve is arbitrary and, in a typical engine, the actual valve opening may be in the order of from about one-third to about three-fourths of the fully opened valve.

Assume that there is no modulation of the valve opening by the springs: The graphs have been drawn with ten units along the time or duration axis. If we assume that the desire is to have the valve open after three units of time and to close three units before the end of the normal valve stroke, this, in effect, eliminates the lower portion of the upper curve of normal valve operation and leaves only the rounded center peak.

It should be noted that during normal valve operation entirely in response to movement of the pushrod, the upper curve has a typical bell shape with low slope ends near the axis (point A in FIG. 7). This bell shaped curve of valve opening is a result of grinding the cam to give a somewhat slow start to valve opening and a deceleration as the valve reaches the valve seat (at the right end FIG. 7).

However, if there is no modulation of the valve opening when one of the radial passages is open, the valve starts and stops movement somewhat abruptly, as indicated by the portion of the upper curve above the dashed line across FIG. 7. This occurs since the valve commences opening (and closes) in a steep portion of the cam profile.

Instead of such an abrupt opening and closing of the valve, what is desired is a flattened bell curve resembling the lower curve in FIGS. 7, 9 and 11. It can be seen that this curve has inflections that start the valve moving gradually and also decelerate the valve near the end of its stroke. This is effected by the Belleville washers, which collectively form a progressive rate spring. The composite spring formed by the thinner and thicker Belleville washers provides a first portion of the stroke of the spring which is smoothly continuous, with a relatively low slope of a force/displacement curve. This occurs as the relatively softer thin Belleville springs 57 compress. There is a relatively larger displacement of the outer sleeve for a given force during this part of the stroke. (Since the denominator is larger, the force/displacement slope is lower.) The spring rate of Belleville washers is approximately linear. Thus, twice as much force compresses the springs twice as far. The force applied for compressing the springs increases as they compress, and concomitantly the force applied to the valve stem by the rocker arm also increases.

The low slope force/displacement continues until the inner Belleville springs 57 are completely compressed, as illustrated in FIG. 8. This corresponds to point B in FIG. 9. The spring constants of the Belleville springs and the valve spring 120 are selected so that, as the force is initially applied to the Belleville springs, there is no significant movement of the corresponding valve stem. Eventually, however, and before the thinner Belleville springs are completely compressed, the force rises to a level where the valve spring is also slightly compressed, and the valve begins to open. This produces the small "tail" at the bottom end of the lower curve in the graphs, i.e., the portion between point A in FIG. 7 and point B in FIG. 9.

In addition to compressing the thinner Belleville springs, the increasing force compresses the thicker Belleville springs 58, but until the thinner Belleville springs are completely flattened, this compression is minor. When the thinner springs are completely compressed, as illustrated in FIG. 8, there is a discontinuity in the force/displacement curve and the second portion has a relatively higher slope, as the thicker Belleville springs are compressed. Since this force increases more rapidly than before, the opening of the valve is accelerated until the hydraulic block occurs and the Belleville springs are all completely compressed, as illustrated in FIG. 10. This could occur, for example, at point C on the lower curve in FIG. 11. From then on, the movement of the valve is in direct response to the profile of the cam.

The reverse occurs as the valve closes. The pushrod retracts as forced by the valve spring, following the profile of the cam until a point is reached where the force acting through the rocker arm pivot and outer sleeve is low enough that the thicker Belleville springs begin to expand again. This forces the pivot downwardly, and, when the thicker Belleville springs are essentially completely expanded, the thinner Belleville springs also begin to expand. The movement of the pivot downwardly is essentially the same as its upward movement, hence the closing side of the lower curve is essentially a mirror image of the opening side. There is an inflection to a curved "tail" that gradually approaches the valve closed position, making for a soft landing of the valve on the valve seat.

It will be recognized that the curves illustrated in the graphs are schematic for purposes of illustration. In the event a non-symmetrical cam is used to operate the pushrod, both the upper and lower curves may be asymmetrical instead of the mirror image bell curves illustrated. The significant feature of a "tail" at each end of the lower curve for soft take-off and landing remain, however.

The progressive rate spring provided by the Belleville washers has a first relatively lower spring force, while the thinner Belleville springs compress, and a higher spring force as the thicker Belleville springs compress (and vice versa, as the springs expand). The illustrated embodiment has four "soft" thin Belleville springs and two stiffer thick Belleville springs. Different numbers of springs and spring forces of the individual washers may be used to achieve the desired shape of the lift versus time curve. One may, for example, use a three-stage progressive spring with one, two or three thin Belleville springs, one, two or three springs with intermediate spring constant, and one, two or three thick Belleville springs. Clearly, the permutations to obtain a desired change in spring force can be easily provided. Essentially any desired modulation of valve movement can be achieved with a combination of springs.

In an additional embodiment, not illustrated, one or more Belleville springs is added between the rocker arm pivot and the operating mechanism that goes into hydraulic lock. In the embodiment illustrated in FIG. 6, for example, there is an outer sleeve 129 extending all the way from the pivot to the Belleville springs at the top. The lower part of this sleeve provides clearance for tilting of the rocker arm. This additional embodiment essentially splits this sleeve into two sleeves with the Belleville spring(s) between the two sleeves. In other words, there is a spring between the pivot and the hydraulic lock operating mechanism.

The lower Belleville spring is stiff enough that it does not deflect until the valve spring begins to compress and the pushrod moves to open the valve. The valve spring begins to compress as the pushrod moves to open the valve. The stiffness of the Belleville spring is sufficient that both springs compress, however, and there is an opening of the valve gradually at the beginning. When the lower Belleville spring is completely compressed (i.e. metal-to-metal) the opening of the valve tracks the cam. Thus, when the cam begins to lift the valve, it simultaneously lifts the pivot and the valve for a short distance, and thereafter, when the Belleville is completely compressed, only the valve continues to lift.

This action occurs regardless of whether the operating mechanism is open or closed. That is, even when the rotatable plug closes all the passages and hydraulic block prevents any motion of the pivot, there is still a small movement of the pivot. Only about 0.03 inch motion is sufficient to provide a lower velocity opening of the valve in the initial part of its stroke. When the plug is set so that one or more passages is open, the lower spring works in series with the hydraulic block to stop the pivot at an upper lock position.

Likewise, this spring serves as a cushion upon return of the pivot to its rest position and assures a soft landing of the valve on the valve seat. Near the end of the closing stroke, the Belleville spring expands and slows the expansion of the valve spring. Instead of a single Belleville spring, a plurality of such springs may be used to cause the pivot to move against a progressive rate spring to modulate valve opening.

Such Belleville spring(s) below the pivot may be used alone or in combination with the modulating spring above the pivot. A progressive rate spring above the sleeve may not be needed when the lower Belleville spring is sufficiently stiff to effect gradual opening of the valve in the initial part of its stroke. A relatively light spring to return the operating mechanism and pivot to their rest position may be enough.

Such an embodiment is readily achieved by adding one or more Belleville springs in a gap indicated by the arrow A in FIG. 4, between the outer sleeve 29 and the link 37.

It should be recognized that although the embodiments described and illustrated prefer Belleville spring washers, other equivalent springs may also be used.

What is claimed is:

1. An internal combustion engine having intake and exhaust valves comprising:

a pushrod;

a rocker arm having a pivot between its ends and having one end engaged by the pushrod;

a valve stem engaging the other end of the rocker arm;

an adjustable stop having at least two positions for the rocker arm pivot, a lock position elevated above a rest position, comprising:

an at least partially hollow member on which the rocker arm pivot is free to slide, an outer sleeve engaging the rocker arm pivot and free to slide on the outside of the member, an annular chamber between the outside of the member and the inside of the outer sleeve, a hole through a wall of the member between the inside of the member and the annular chamber; and an obstruction which permits flow or blocks flow through the hole; and a spring which is deformed before the pivot reaches the lock position, a first portion of the stroke of the spring being smoothly continuous with a relatively lower force/displacement slope and a second portion of the stroke of the spring being smoothly continuous with a relatively higher force/displacement slope.

2. An internal combustion engine according to claim 1 wherein the obstruction comprises an inner sleeve in the member with an end portion adjacent to the hole and the end portion configured to either open or close the hole.

3. An internal combustion engine according to claim 1 further comprising an additional lock position between the lock position and the rest position.

4. An internal combustion engine according to claim 3 wherein the rest and two lock positions are selected by movement of a member for alternatively permitting or preventing liquid flow through holes adjacent to the hydraulic block position of the adjustable stop.

5. An internal combustion engine intake and exhaust valves comprising:

a pushrod;

a rocker arm pivoted between its ends and having one end engaged by the pushrod;

a valve stem engaging the other end of the rocker arm;

a selectively movable pivot supporting the rocker arm, the movable pivot having a lower rest position and an upper lock position, the upper lock position being determined by liquid trapped in a volume which is closed in response to upward movement of the pivot;

the pivot having an intermediate lock position between rest position and the upper lock position;

a check valve preventing trapped liquid from escaping when in a lock position;

a radially extending passage through which liquid can pass;

a first sleeve controllably movable for closing or opening one end of the passage; and a second sleeve movable in response to movement of the pivot for closing or opening the other end of the passage.

6. An internal combustion engine according to claim 5 wherein the first sleeve is rotatable and the second sleeve moves longitudinally.

7. An internal combustion engine according to claim 5 further comprising a second radially extending passage through which liquid can pass, one of the passages having an upper edge further from the pivot than the upper edge of the other passage.

8. A method of operating an internal combustion engine having intake and exhaust rocker arms mounted on pivots for opening engine valves, each rocker arm engaged by a pushrod at one end and a valve stem at the opposite end, comprising:

moving a rocker arm pivot in response to movement of a pushrod; and using a hydraulic block to hold the rocker arm pivot in or near a rest position;

using a hydraulic block to stop the pivot movement at an upper lock position; and using a hydraulic block to stop the pivot movement at an intermediate lock position between the rest position and the upper lock position;

using at least partially hollow member on which the rocker arm pivot is free to slide, using an outer sleeve engaging the rocker arm pivot which is free to slide on the outside of the member, using an annular chamber between the outside of the member and the inside of the outer sleeve having a hole through a wall of the member between the inside of the member and the annular chamber; and using a hydraulic block to permit flow or blocks flow through the hole; and using a spring which is deformed before the pivot reaches a lock position, with a first portion of the stroke of the spring smoothly continuous with a relatively lower force/displacement slope and a second portion of the stroke of the spring being smoothly continuous with a relatively higher force/displacement slope.

* * * * *